United States Patent [19]

Mocarski et al.

[11] 4,069,044

[45] Jan. 17, 1978

[54] METHOD OF PRODUCING A FORGED ARTICLE FROM PREALLOYED-PREMIXED WATER ATOMIZED FERROUS ALLOY POWDER

[76] Inventors: Stanislaw Mocarski, 3661 Rockwell, Windsor, Ontario N9E 2B1, Canada; Daniel W. Hall, 25487 Kennedy, Dearborn Heights, Mich. 48127

[21] Appl. No.: 765,334

[22] Filed: Feb. 3, 1977

Related U.S. Application Data

[62] Division of Ser. No. 691,914, Aug. 6, 1976.

[51] Int. Cl.[2] ..... B22D 23/08; B22F 1/00

[52] U.S. Cl. ..... 75/243; 75/246; 75/251

[58] Field of Search ..... 75/243, 246, 255, 251, 75/252, .5 BA

[56] References Cited

U.S. PATENT DOCUMENTS

| | | | |
|---|---|---|---|
| 3,676,103 | 7/1972 | Le Brasse et al. | 75/.5 BA |
| 3,798,022 | 3/1974 | Le Brasse et al. | 75/.5 BA |
| 3,901,661 | 8/1975 | Kondo et al. | 75/255 |

*Primary Examiner*—W. Stallard

[57] ABSTRACT

A method of making powder metal compacts having a low but optimized alloy content, the compacts being characterized by improved response to heat treatment (hardenability) and improved physical characteristics. A ferrous based powder is prepared having a predetermined particle size (about −80 mesh), a low $O_2$ content (less than .25%), a predetermined particle shape, less than .04% carbon and balanced pre-alloyed ingredients (.2–1.0% nickel, .2–.8% Mo, and .25–.6% Mn). A nonferrous based powder having at least a high content of copper (−320 mesh if pure copper or about −200 mesh if alloyed copper) is admixed with the prealloyed ferrous based powder to achieve a Cu content of .2–2.1% in the resulting sintered material. Graphite powder is also admixed (.1–1.0% of admixture) to provide a carbon content of at least .17%, but up to .65% in the sintered material; the graphite is preferably a naturally occurring crystalline flake with up to 4.9% max. The admixture is compacted to form a preform having a green density of about 6.4 g/cm³ and the same weight as the intended forged product but with greater length and reduced width. The preform is ready to be sintered in a low $O_2$ potential furnace at between 2050°–2500° F and subsequently hot forged at about 1800° F under a force of 50 to 100 tons/in².

Also disclosed are related methods of making powder ingredients for compacts and the method of carrying the process through the forging stage. Variations of the alloying ingredients in said admixed powders include: (a) employing 0.4–0.65% each of one or all of the alloying ingredients for said prealloyed iron powder, admixing the ferrobased powder with pure copper powder (99.5% pure) in the amount typically about .9% of the mixture, (b) employing a 0.40–0.65 Ni, 0.45–0.65 Mo) prealloyed iron powder with a Cu-Mn powder, (c) employing a Mo prealloyed iron powder admixed with a Cu-Mn-Ni powder or Cu-Mn powder, or (d) employing Mo and Ni in the prealloyed ferrobased powder limited to .19% and employing additional Ni and Mn in a nonferrous based powder having copper to be admixed; graphite powder is added to the admixture in all of the foregoing.

4 Claims, 11 Drawing Figures

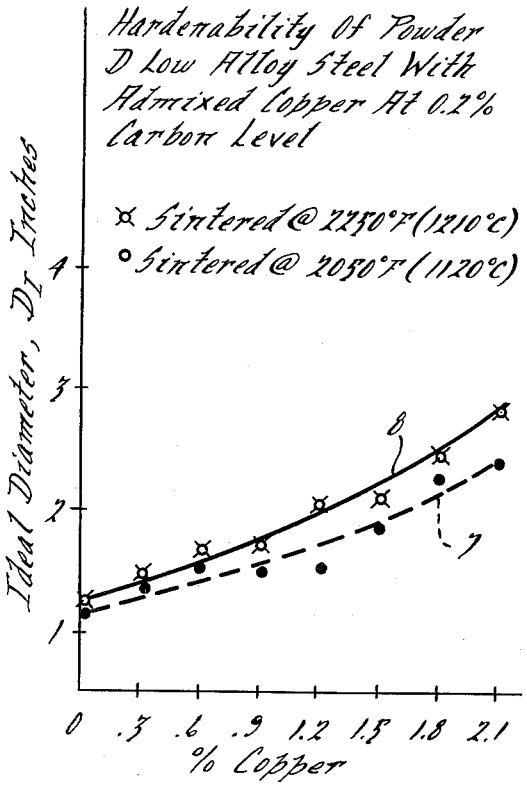
FIG. 2.
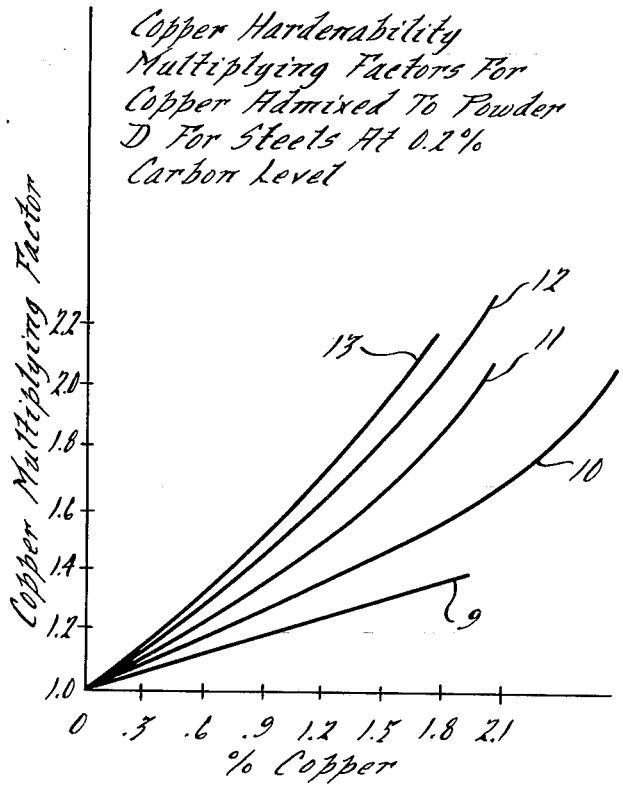
FIG. 3.
FIG. 4.
FIG. 5.
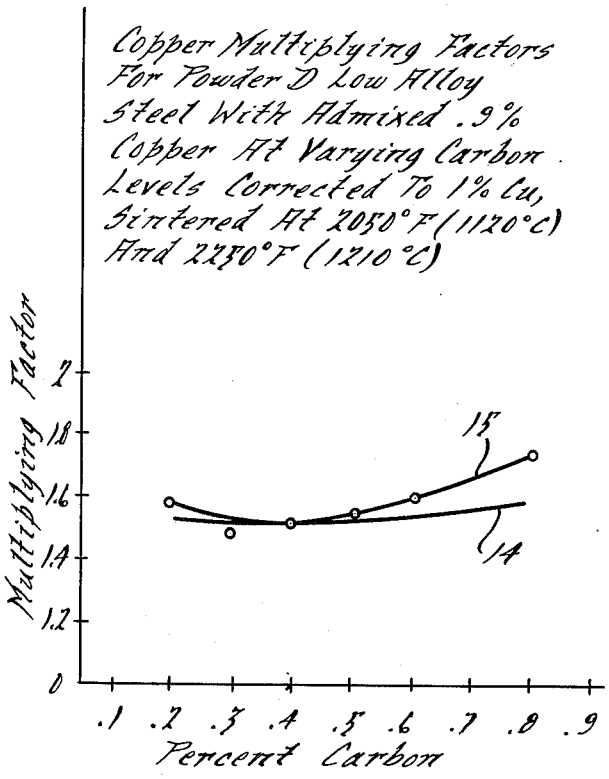
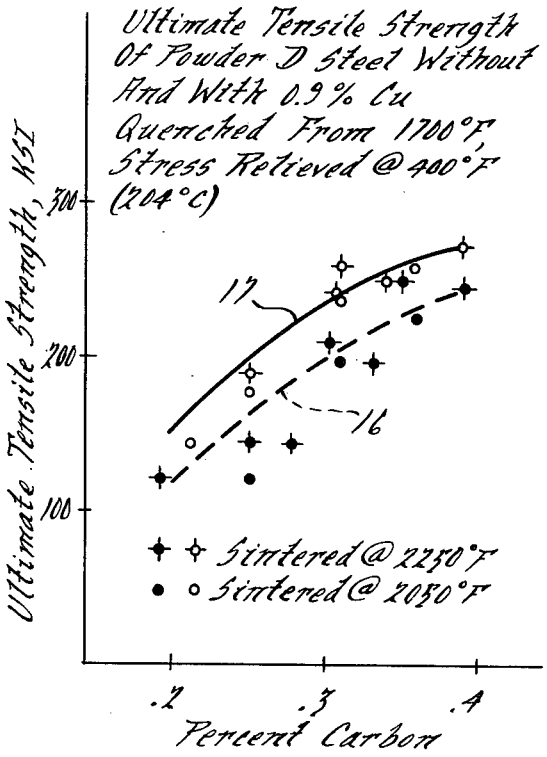

X 1000

Microstructure Of Powder D With 0.9% Cu. Quenched And Tempered. Etched In Nital.

X 1000

Microstructure Of Powder D With No Copper Addition. Quenched And Tempered. Etched In Nital.

METHOD OF PRODUCING A FORGED ARTICLE FROM PREALLOYED-PREMIXED WATER ATOMIZED FERROUS ALLOY POWDER

This is a Division of application Ser. No. 691,914, filed Aug. 6, 1976.

BACKGROUND OF THE INVENTION

U.S. Pat. No. 3,889,350, commonly assigned to the assignee herein, outlines a favorable composition of a prealloyed powder metal which is useful in providing excellent hot formed steel when applied to the making of heavily stressed automotive components such as connecting rods, converter lockup clutch races, differential gears and similar parts. This powder metallurgy steel is characterized by a high impact strength of about 40–50 ft. lbs., at 0.35% C, quenched and drawn to $R_c$20 (110 KSI UTS, 100 KSI Yield Strength, 28% Elongation, 55% Reduction of Area). The patent taught precise control of alloying ingredients within narrow ranges to allow for maintaining the oxygen content of said powder supply at a low level when subjected to water atomization. It was found that if the principal alloying ingredients, like nickel and molybednum, were controlled to an amount essentially about 0.5% of the mass of powder and manganese controlled to the range 0.3–0.4%, the oxygen could be kept below 0.25%. Unfortunately, such prealloyed powder gives a hardenability slightly less than the now popular modified 4600 powder metallurgy steel composition containing approximately 2% nickel and 0.5% molybdenum with the balance of iron. Thus, even though a successful and less expensive prealloyed powder was formulated, such powder when subjected to a complete powder metallurgy sequence, including hot forming, did not give the type of response to heat treatment that was competitive or advantageous over that currently known. To be successful, powder metallurgy techniques must be able to provide a substitutable product for the same type of steel which is wrought.

A physical multiplying factor must be found through chemistry or process sequence which dramatically improves the hardenability response in powder metallurgy techniques. More specifically, it is most desirable for the prior art to be able to obtain at least a 1.5 inches value for $D_i$ when the powder content contains carbon at about 0.2%, which is a carburizing grade steel.

The prior art has shown an increase in hardenability when prealloyed. However, such improvement in hardenability response is limited to the higher carbon additions. Such steels, however, are not suitable for carburizing as the core toughness decreases with increasing carbon content.

SUMMARY OF THE INVENTION

A primary object of this invention is to provide a method which will increase the hardenability response of sintered powder ferrous based shapes which have a low but controlled alloy content.

A particular aspect of this object is to provide increased hardenability beyond that found in current literature and greater than that of an alloyed powder with prealloyed copper.

Another object of this invention is to provide a method of forming powdered shapes which will have an increased homogeneous microstructure along with an increase in hardenability of at least 30% particularly at low carbon levels.

Another object is to provide a method of forming powdered prealloyed shapes with low alloy content. said process being particularly characterized by low cost, the avoidance of additional inventory items of powder over that now utilized by the prior art, and an increase in ultimate tensile strength and hardenability for equivalent chemical content powdered shapes according to the prior art.

Another object of this invention is to provide a novel system of hardenability control, which is superior to conventional prealloying, by balancing the composition through variation of carbon and hardenability agent additions to tailor the hardenability within narrow limits to suit any required application.

Yet still another object of this invention is to provide a method of making a powdered compact including the resulting compact which provides a substitutable ferrous based metal material having a low alloy content which balances adequate ductility of the resulting compact with increased hardenability and strength to provide optimum mechanical characteristics at such low alloy content.

Specific features pursuant to the above objects comprise: (a) the admixture of copper powder to ferrous based powder in a predetermined proportion to produce improved strength and hardenability, (b) the preparation of a ferrous based powder and nonferrous based powder and a graphite powder, said powders being admixed with the ferrous based powder, the latter consisting of iron and molybdenum with or without nickel in controlled amounts of 0.4–0.65%, and the nonferrous based powder consisting of copper and manganese in generally equal proportions, the nonferrous based powder being admixed in a proportion of 0.2–2.1% of the compact and the graphite being added in amounts between 0.2–1%, (c) regulating the sintering temperature to be at a higher level about 2250° F when maximum hardenability and copper effectiveness is desired.

SUMMARY OF THE DRAWINGS

FIG. 2 is a graphical illustration of hardenability plotted against the variation of percent copper in the sintered and hot compacted shape according to the teaching of the present invention;

FIG. 3 is a graphical illustration of the hardenability multiplying factor plotted against variation in percent alloy content (such as copper or nickel);

FIG. 4 is a graphical illustration illustrating the variation of the hardenability multiplying factor with percent carbon within the compacted and sintered powder shape;

FIG. 6 is a graphical illustration of the ultimate tensile strength, yield strength, elongation and reduction in area of powder metallurgy steels prepared according to the instant invention and some not, at 0.2% carbon level and with varying copper, sintered both at 2050° F and 2250° F;

Figure 1:
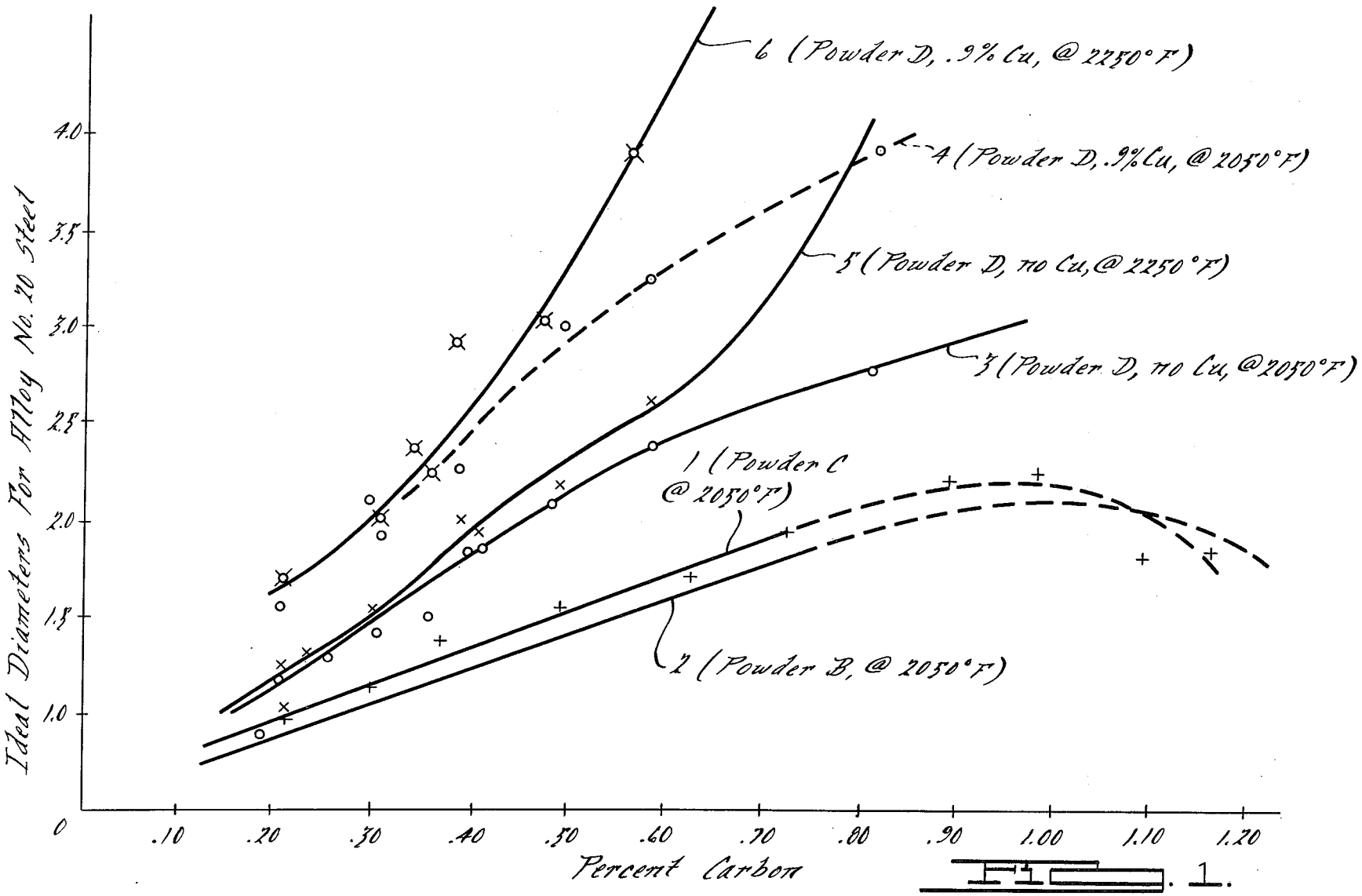
FIG. 1 is a graphical illustration comparing hardenability of sintered and hot compacted shapes, some being prepared according to the instant invention and some not, said hardenability being plotted against carbon content.

Table I is a listing of powder samples and associated chemistry;

Table II is a listing of sintered samples and associated chemistry determined by electron microprobe quantitative chemical analysis, the analysis was performed on samples prepared with powder D, some according to the invention and some not in accordance with the invention;

Table III is a listing of physical characteristics measured for a number of sintered samples prepared according to the invention and some not in accordance with the invention, but all sintered at 2050° F;

Table IV is a listing of physical characteristics measured for a number of sintered samples prepared according to the invention and some not in accordance with the invention, but all sintered at 2250° F;

Table V is a listing of physical characteristics measured for a number of samples prepared according to the invention and some not in accordance with the invention, but all sintered at 2050° F, a series with 0.2% carbon and copper additions from 0–2.1%;

Table VI is a listing of physical characteristics measured for a number of sintered samples prepared according to the invention and some not in accordance with the invention, but all sintered at 2250° F, a series with 0.2% carbon and copper additions of 0–2.1%.

DETAILED DESCRIPTION

It was discovered that copper powder when admixed as pure copper or admixed as a prealloyed nonferrous powder, to a ferrous based powder, containing one or more preferred alloying ingredients, rendered an increase in strength and also a synergistic increase in hardenability for a compact formed from such admixed powders (when sintered in a temperature range of 2050°–2250° F and subsequently hot formed to a density of 99% plus). Admixed copper was found to increase the multiplying factor dramatically with increasing nickel and molybdenum contents up to a limit determined by economics. It was further discovered that proper proportioning of admixed copper and alloying ingredients within the ferrous based powder or admixed powder can provide a sintered forged shape which is substitutable for wrought SAE steels of different series.

A preferred method for improving the hardenability of prealloyed ferrous based powders is as follows:

a. The ferrous based powder is prepared by atomization of a molten metal stream which is limited in alloy content to contain 0.4–0.65% of molybdenum with or without nickel, the remainder being essentially iron. The atomized low alloy ferrous powder particles should be prepared to have an oxygen content no greater than 0.25% (preferably less than 0.20%), and a carbon content less than 0.04%. Each of the particles should have a substantially irregular spherical configuration to facilitate compaction. To facilitate the latter characteristics the atomized particles can be collected after solidification and subjected to annealing at 1700° F for about 1½ hours, followed by grinding to break up particle cakes, and then passed through an 80 mesh sieve.

b. The prepared ferrous based powder is then exposed to copper and graphite in predetermined proportions while under heated conditions in the temperature range of 2050°–2250° F while under a protective atmosphere. The exposure to copper and graphite can be preferably accomplished by admixing a copper powder having a purity of 99% + and a natural graphite flake powder containing up to 4.5 max. ash. The copper powder is admixed in a proportion depending upon the alloy content in said ferrous based powder; with an alloy range of molybdenum and nickel of 0.4–0.65% by weight and 0.3–0.4% manganese in the ferrous powder, the copper powder is admixed in a range of 0.2–2.1% by weight of the admixture, and the graphite powder is added to render a final carbon content in the sintered product of at least 0.17% up to 0.65%.

A method for making a powdered metal low alloy forging in accordance with this invention, would comprise:

a. Preparation of a ferrous based powder containing oxygen in an amount less than 0.25% (and preferably less than 0.20%) and containing one or more of the following: 0.25–0.6% manganese, 0.2–1.0% nickel, 0.2–0.8% molybdenum and less than 0.01% carbon.

b. Preparation of a nonferrous based powder preferably consisting solely of copper, but may consist of copper prealloyed with manganese in a ratio between 1:1 to 10:1 (preferably 3:1–5:1), the ratio being copper to manganese, or copper prealloyed with nickel and manganese, the ratio of copper to nickel to manganese being preferably 5:1:2.

c. Admixing the nonferrous based powder, a graphite powder and the ferrous based powder, with the graphite powder being in a proportion of between 0.1–1.0% by weight of the admixture, the nonferrous based powder is added in an amount of 0.2–2.1% by weight of the admixture (when employing pure copper) or up to 3% when other elements are contained.

d. The admixture is then compacted under sufficient force to define a preform having a density and configuration to facilitate handling and subsequent hot forming into a desired shape.

e. The preform is sintered in a low oxygen potential atmosphere, at a temperature of 2050°–2250° F. The low oxygen potential atmosphere may be obtained by using a dry hydrogen atmosphere, dissociated ammonia or nitrogen-hydrogen mixtures dried by using molecular sieves.

f. The sintered preform is then hot formed at a temperature of about 1800° F under pressure of 50 to 100 tons per square inch to define a forged shape having a density in excess of 99%.

To optimize the copper efficacy for purposes of increasing synergistically the hardenability and/or strength, the method is modified to utilize a higher sintering temperature, at least 2250° F, and the graphite admixture is adapted to provide an ultimate carbon range which is optimized to provide the best combination of hardenability and mechanical properties. The highest copper multiplying factor was obtained by (a) regulating nickel and molybdenum each to a range of about 0.45–0.65% and (b) controlling the copper/Mo or Ni ratio.

A variation of the preferred method providing a forging is that which will produce only a preform in the unsintered condition. Such a method variation is as follows:

a. Preparing a ferrous based powder preferably by water atomization whereby a molten steel stream is subjected to sheets or jets of water to define slightly irregular spherical particle configurations. The molten steel stream is comprised of low alloying ingredients, consisting of one or more of molybdenum in the range of 0.2–0.8%, nickel in the range of 0.2–1.0%, and manganese in the range of 0.25–0.6% (weight % of the molten metal), the resultant raw atomized powder having an oxygen content less than 0.8%.
b. The atomized powder is annealed at a temperature of about 1700° F, to soften the atomized powder, decrease its carbon content and reduce its oxygen content to less than 0.25%.
c. The prealloyed steel powder is then admixed with graphite powder to achieve a carbon content in the preform of at least 0.17% and admixed with a copper powder having a purity of 99% + to achieve a copper content in the preform of between 0.2–2.1% by weight of the admixture.
d. The admixture is then compacted into a shape suitable for final sintering and heated to temperature 2250°–2350° F for 3 minutes, temperature dropped to 1800°–2000° F and hot forged to a density of about 99% +. The copper addition should be made to obtain the hardenability required at the specified carbon level. The greater the cross-section and the mass of the part, the greater are the ideal diameter $D_i$ and hardenability requirements.

A preferred composition consisting of a prealloyed ferrous based powder useful for promoting optimum hardenability when exposed to carbon and copper during sintering is as follows:

a. The metal powder has a particle size of −80 mesh; each particle of powder is characterized by substantially irregular spherical configuration and consists of a steel alloy containing 0.4–0.65% by weight of molybdenum with or without nickel, the remainder being essentially iron, the nickel and molybdenum being distributed through each particle to form an alloy rich phase at the outer region of each of said particle during atomization (subsealed concentration). The powder has an oxygen content no greater than 0.25%, and a carbon content less than 0.04%. The variation of said powder may contain manganese in a proportion of 0.25–0.6% by weight.

A variation of said composition comprises a ferrous based powder previously water atomized to obtain an oxygen content less than 0.25%, and annealed to soften the powder. The content of said ferrous based powder is limited to have up to 0.19% each of nickel or molybdenum, with the remainder being essentially iron. A second powder of the composition is nonferrous based, containing one or more of manganese, nickel along with copper. When admixed, the total nickel content is sufficient to provide an equivalent of 0.4–0.65% if prealloyed.

The principal discovery, as claimed herein, is that the admixture of copper (as opposed to prealloying copper with a ferrous based powder) produces a far superior hardenability and strength improvement. Hardenability is the capacity for steel to respond to heat treatment to produce hardening. Hardenability has a two fold significance, it is important not only in relation to the attainment of a higher hardness or strength level by heat treatment but also in relation to the attainment of a high degree of toughness through heat treatment. Hardenability is really depth of hardening and refers principally to the size of a piece which can be hardened under given cooling conditions and not the maximum hardness that can be obtained for the given steel. Maximum hardness depends almost entirely upon carbon content, while hardenability is in general far more dependent upon the alloy content and grain size of the austenite than upon the carbon content. These alloying elements, in general, decrease the rate of transformation of austenite at subcritical temperatures, thereby facilitating the attainment of low-temperature transformation to martensite or lower bainite when these are the end products desired, without prior transformation to unwanted higher temperature products. Thus, alloy steels of equal hardenabilities, but utilizing different combinations of alloying elements, are generally interchangeable for heat treatment to produce a desired microstructure. This principle of hardenability permits an intelligent choice of alloying combinations, which for reasons of economy or availability, are best suited for particular applications.

The effect of the alloy on hardenability may be quantitatively evaluated by hardenability measurements taken in terms of the ideal diameter for the microstructure of 50% martensite. When the ideal diameter of the steel, containing a desired alloying ingredient, is divided by the base hardenability of the steel containing no such alloying ingredient, this ratio expresses the effect of the element on hardenability and is known as a multiplying factor. It is generally accepted state of the art knowledge that the cumulative effect of alloying ingredients on hardenability can be evaluated by multiplying the base hardenability of the iron-carbon alloy progressively by the multiplying factors for each of the elements added. However, as shown by test examples, this cumulative effect of multiplying factors of prealloyed ingredients did not produce the highest hardenability effect. It was not until copper was admixed that the desired increased results were obtained.

Experimental Procedure

To define the effect of copper on the hardenability of powder metal steels with small additions of alloys in the ferrous based powder, a variety of samples of prealloyed ferrous based powder were prepared with varying alloying contents, some including copper and some excluding copper in their prealloyed condition. These prealloyed powders were sintered and hot formed to determine the effect of copper without being admixed. Other samples were prepared with the copper admixed (as a separate powder) to a prealloyed ferrous based powder containing varying amounts of alloying ingredients. The powders to be preformed were mixed with graphite in incremental amounts as indicated in the test data; a 1% compacting lubricant was added to facilitate lubrication in the compacting die. Each of the powders were blended or used alone and compacted into cylinders having a 3 inch (76 mm) diameter and a 1.7 inch (43 mm) length, then sintered at a temperature in the range of 2050°-2250° F in a protective atmosphere, such as a dry hydrogen atmosphere (−80° F or −62° C dew point). The sintered compacts were reheated in an endothermic atmosphere of appropriate carbon potential at 1800° F (982° C) and hot formed into cylinders having a 4 inch (101 mm) diameter; the die was preheated to 450°-500° F (332°-260° C) and a 1600 ton hydraulic press was employed. Reduction during the forming process was 78%. To insure complete pore closure and to eliminate density variations, a forming pressure of approximately 100 tons per square inch (1.4 kg/mm square) was used. The finished hot formed part was a 4 inch (101 mm) diameter cylinder 1.1 inch (28 mm) thick. Usually 2 Jominy bars were provided 1 inch (25.4 mm) in diameter and 3 inches (76 mm) in length having a flanged end screwed to the top of each Jominy bar to provide the 4 inch (101 mm) standard length for a Jominy test. The Jominy bars were end-quenched after both a ½ hour and a 1 hour austenitizing time at the appropriate temperature, as per SAE procedure (standard J 406). The Jominy bars were analyzed for carbon and oxygen; several bars from each heat were examined for ASTM grain size. All samples had a grain size of 8 ± 0.5 and generally no correction for grain size was made. The Jominy curves were plotted and the 50% martensite point was determined by the relationship developed by Hodge or Orehoski (see "Relationship between Hardenability and Percentage of Martensite in Some Low Alloy Steels," trans. AIME, Vol. 167, 1946, pgs. 280-294). The distance from the quenched end to this point was thusly established. The ideal diameter was used as a measure of hardenability; this was obtained from the relationship originally developed by Grossman and determined more accurately by Carney (see trans. ASM, Vol. 46, pg. 882 - 1954). The ideal diameters for a series of samples were plotted vs. carbon content indicating the contribution copper made to the hardenability. Since Jominy test values showed a certain degree of scatter, the average $D_i$ curves were obtained to permit the calculation of the multiplying factors at different carbon levels. The formula of Grossman was used for all hardenability calculations: $D_i = C_f \times Mo_f \times Mn_f \times Ni_f$. The copper multiplying factor, found by extrapolating to the 1% copper level, was approximately 1.2 which is in agreement with the value for conventional steels reported by Grange, Lambert and Harrington (see "Effective Copper and Heat Treating Characteristics of Medium Carbon Steel," trans. ASM, Volume 51, pg. 377 - 1959).

Evaluation of Test Data

Turning first to FIG. 1, it can be seen by comparison of plots 1 and 2, that the powder containing copper prealloyed in the amount indicated in Table I No. C, showed an improvement in hardenability over that where the copper was eliminated or maintained absent from the prealloyed powder, such as in No. B. However, the hardenability improvement obtained was very small. Many more prealloyed compositions were tried without success. What was sought was a hardenability with an ideal diameter of at least 1.5 inches (38 mm) at the 0.2% carbon level; this would be a control point indicating improvement throughout the carbon range. Other prealloyed powder compositions employed were used varying the alloying ingredients of Mn, Ni and Mo; as a group they demonstrated that considerable difficulty would be encountered in obtaining high hardenability of powder metallurgy hot formed steels at low carbon levels. At high carbon levels, satisfactory hardenability was obtained, but not of sufficient degree to allow such compositions to be substitutable or equivalent to the SAE 8600 series.

As shown by plots 3-6 of FIG. 1, admixing of copper resulted in considerable success. Examples D-1 through D-11 (see Tables III and IV) employed the ferrous based powder D (Table I) consisting of small balanced amounts of manganese, nickel, and molybdenum. Copper was admixed in an amount of 0.9% by weight or was absent; graphite was admixed in varying amounts from 0.2 to 0.8% in steps of approximately 0.1%. The size of the copper powder was −320 mesh, and the particle size of the natural crystalline flake graphite powder was about 0.7 microns A.P.D. (Fisher Sub-Sieve Sizer Method). The same ferrous based powder composition D when admixed with copper and when not admixed, showed a dramatic difference when sintered at a 2050° F (compare plots 3 and 4) and when sintered at 2250° F (compare plots 5 and 6).

Turning now to FIG. 2, there is shown plots 7 and 8 of hardenability vs. copper content for respectively samples D-8 (at about the 0.2% carbon level and sintered at 2050° F, (1120° C) and sample D-2 (at about the 0.2% carbon level and when sintered at 2250° F, (1210° C)). It can be seen that the increase of hardenability due to copper is greater at the higher sintering temperature and at higher copper contents, as shown by the increasing slope of the $D_i$ curves. A 2.1% copper addition to the sample D results in an ideal diameter 2.85 inches (72/mm) when sintered at 2250° F and nearly 2.4 inches (61/mm) when sintered at 2050° F. The striking increase in hardenability due to admixed powder and sintering at 2250° F is also illustrated in FIG. 1, plots 3-6; hardenability of powder D with no copper added and with 0.9% admixed copper sintered respectively at the two temperatures of 2050° F and 2250° F, demonstrate the desirability of admixed copper and higher temperature sintering. A hardenability value of 6.7 inches (170/mm) is obtained at a carbon level of 0.81% when sintered at the higher temperature.

Turning now to FIG. 3, the variation of the multiplying factor due to the admixture of copper is illustrated for different amounts of copper. Plot 9 represents the copper multiplying factor for conventional steel as determined by Grange, Lambert and Harrington, "Effect of Copper on the Heat Treating Characteristics of Medium Carbon Steel", Transactions ASM, Vol. 51, p. 377-1959. Curve 10 represents the multiplying factor of nickel in low-alloy carburizing grades of steel as determined by De Retana and Doane (see "Predicting the Hardenability of Carburizing Steels" report of December 21, 1970 by Climax Molybdenum of Michigan, graphs also available in the Metal Progress Data Book, 1975). Plot 11 represents the multiplying factor for sample D when sintered at 2050° F. Plot 12 represents the multiplying factor for powder D when sintered at 2250° F, and plot 13 represents the multiplying factor for powder A when sintered at 2050° F. It is obvious from the comparison of these curves sintering at the higher temperature results in better solution of copper and therefore produces a higher copper multiplying factor. Many of the curves are similar to parabolas. The parabolic shape of plot 10 clearly is parabolic starting at about 1.5% nickel. The highest copper multiplying factor is for iron-based powder A, having Mo and Ni, and admixed with 0.3–1.8% copper. Powder A contains 0.17% more nickel than powder D. The higher copper multiplying factor of powder A, when admixed with copper, is thought to be due to the synergistic effect of molybdenum with nickel plus copper, nickel and copper acting in a similar mode when added to a molybdenum powder metallurgy steel.

FIG. 4 illustrates the multiplying factor for powder D admixed with 0.9% copper at varying carbon levels (corrected to 1% Cu) for both sintering temperatures of 2050° F (1120° C), see plot 14, and 2250° F (1232° C), see plot 15. Sintering at 2050° F exhibits a minimum at 0.4% carbon, a slight increase in the factor at 0.2% carbon, while a significant increase is noted at the high carbon levels. When sintered at 2250° F, the multiplying factor at 0.8% carbon increases to 1.75 while it is 1.52 for both sintering temperatures at the 0.4% carbon level.

Electron Microprobe Evaluation of Microdistribution of Copper and Manganese

Table II summarizes the quantitative values of the copper and maganese weight percent analysis as determined by electron microprobe traverses at 6 micron intervals. The samples of powder D had a final carbon content of approximately 0.3%, and were sintered either at 2050° F (1121° C) or 2250° F (1232° C) without any copper or with 0.9% admixed copper. The samples without copper exhibited significant scatter of the microcomposition of prealloyed manganese, the 4 sigma range being + 10% from the mean manganese content of 0.34% for the 2050° F (1121° C) sintering temperature and + 7% for sintering at 2250° F (1232° C). The addition of copper reduced the scatterband of the manganese content for both temperatures of sintering to one third of the above values. The microdistribution of admixed copper after sintering as calculated by + 2 sigma values was + 18% from the mean for 2050° F (1121° C) and + 4% for 2250° F (1232° C) temperature of sintering, the higher sintering temperature resulting in better diffusion.

It was desired to determine the distribution of copper and manganese relative to the grain boundaries and ten microanalysis traverses were run across the grains for each sintering temperature. No correlation between the copper or manganese concentration and the proximity of grain boundaries was determined. In some cases, the copper content was decreasing toward the middle of the grain, in some cases it was significantly higher at one grain boundary than the other, suggesting that the distribution of the copper powder after mixing and the powder particle size were most likely of more significance than the diffusion along the grain boundaries,

Mechanical Test Results

Figure 5:
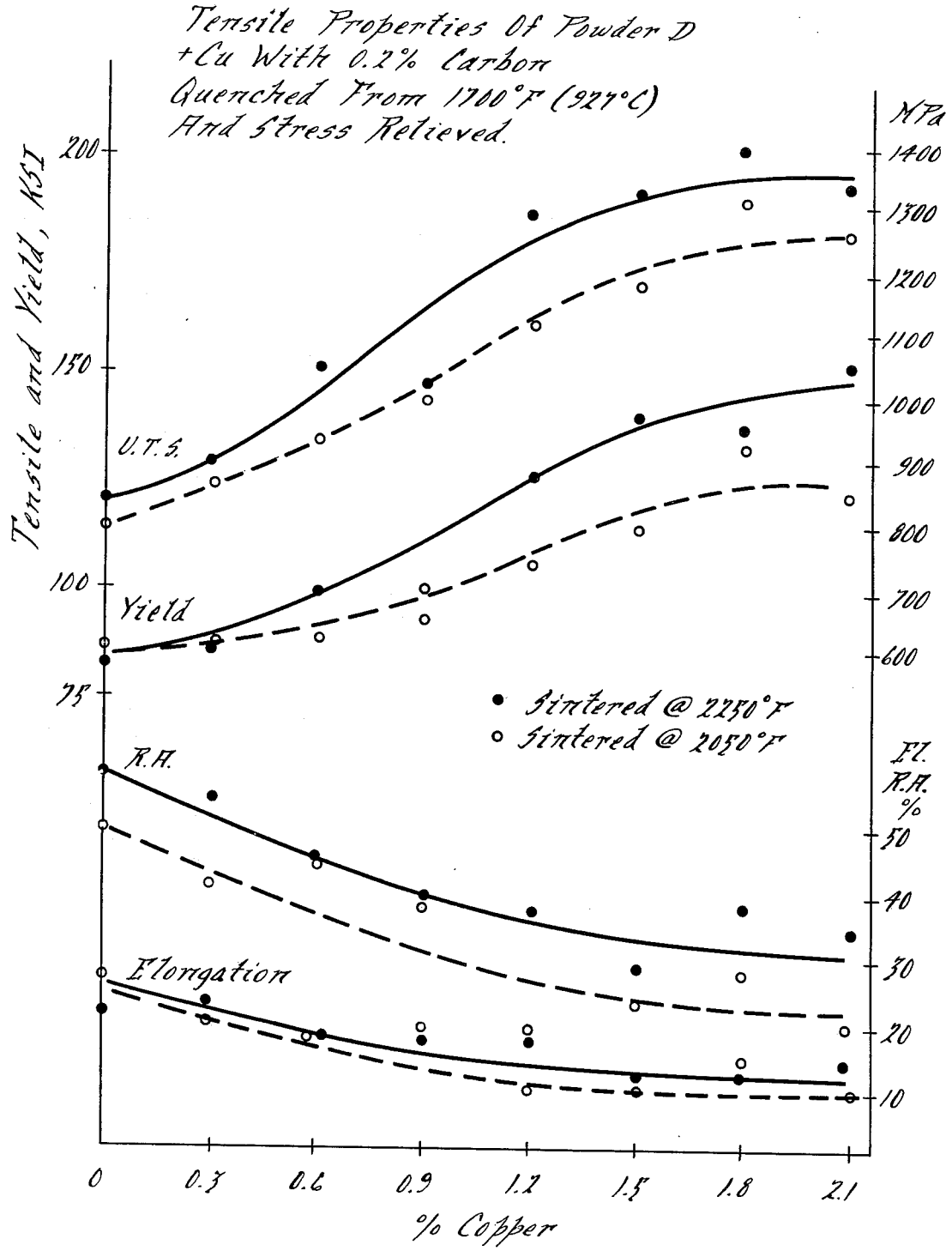
FIG. 5 is a graphical illustration of ultimate tensile strength plotted against percent carbon for a number of samples prepared in process according to the teaching of the present invention and some not.

Mechanical test results for samples D-7 through D-11 and F are listed in Table III. Results for samples D-1 through D-6 and E-1 through E-4 are listed in Table IV. All samples were quenched from 1700° F (927° C) and stress relieved at 400° F (204° C). The data for ultimate tensile strength taken from Tables III and IV is plotted in FIG. 5. Plot 16 represents data with nil copper and plot 17 represents data having admixed copper. The addition of copper increases the tensile strength by increasing hardenability and by solid solution strengthening; therefore, the samples harden to a higher value. All samples, with and without copper, have comparable ductility and impact strength, the values being higher for sintering at 2250° F than for sintering at 2050° F. Ductility is dependent upon the hardness and the oxygen content of the samples. It can also be seen that a ferrous-based alloy steel powder having small but balanced amounts of molybdenum, nickel and manganese along with 0.9% copper admixture, will provide mechanical properties of the same order of magnitude as the commercial 5135H steel, designated F. The physical characteristics taken in the longitudinal direction and in the transverse direction for samples F are shown at the bottom of Table II. The 5135H steel has poor ductility and very low impact strength in the transverse direction. The maximum strength achieved by any of the samples is represented by sample E-4, where the ultimate tensile strength was 272.5 ksi, yield strength of 224.8 ksi, and elongation of 12.5%, a reduction of area of 24%, and a V-Notch charpy impact at −60° F of 8 ft. lbs.

Figure 7:
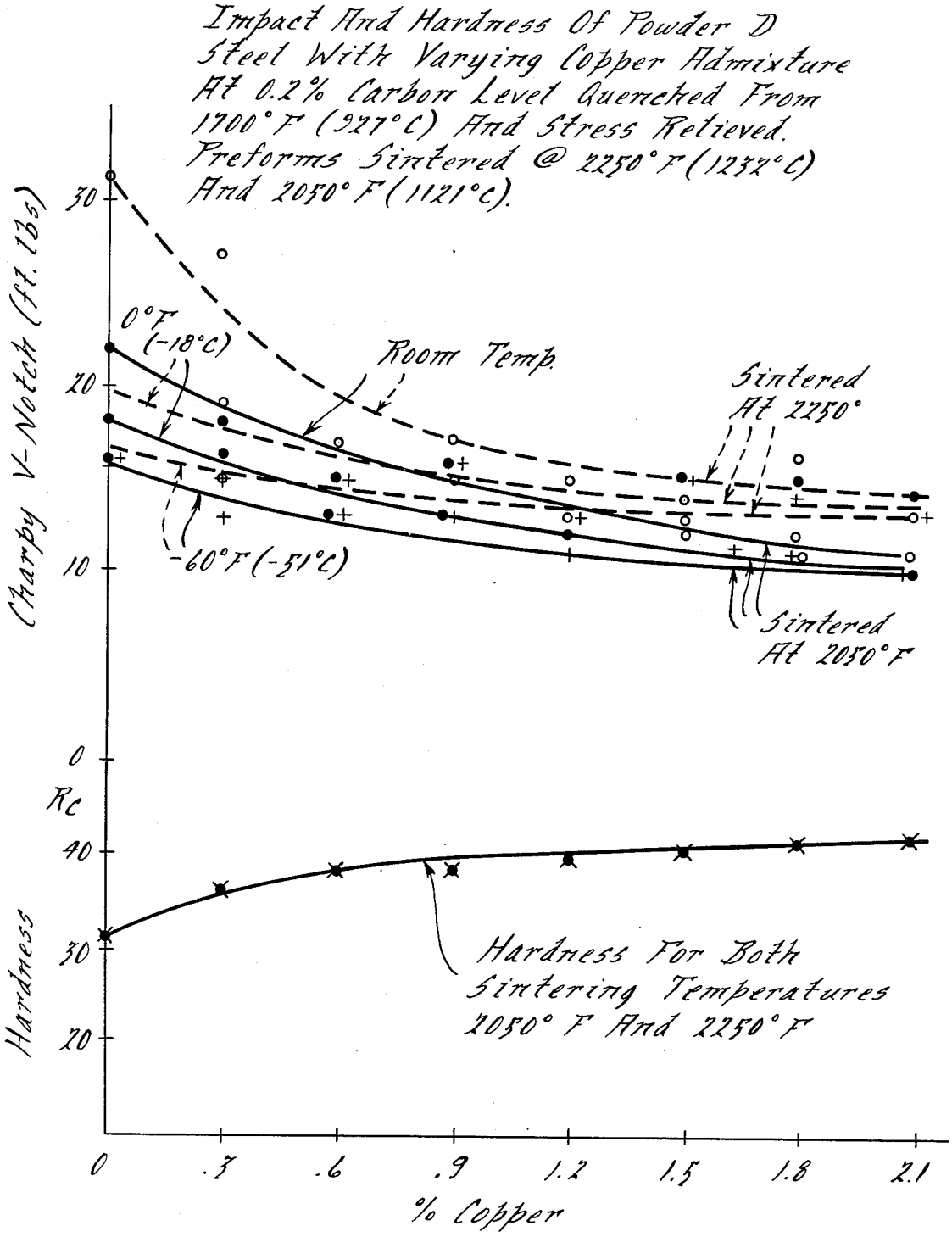
FIG. 7 is a graphical illustration of the hardness and also impact strength of powder metallurgy steels some prepared according to the instant invention and some not, at 0.2% carbon level and with varying copper, sintered both at 2050° and 2250° F.

Tensile test results for steels using powder D with a carbon content of about 0.2% (typical content for carburizing steels) and copper additions up to 2.1%, quenched from 1700° F (927° C) and stress relieved at 400° F (204° C), are given in Tables V and VI and plotted in FIG. 6, impact strength and hardness results being shown in FIG. 7 for two different test temperatures. It can be seen that copper additions to 2.1% Cu increase the tensile strength from 114 ksi (786 MPa) to 183 ksi (1262 MPa) for sintering at 2050° F (1121° C) and from 120 ksi (826 MPa) to 194 ksi (1338 MPa) for sintering at 2250° F (1232°C). Most of the improvement in tensile properties is already achieved at approximately 1.5% copper and further increase in copper content gives a relatively small gain in the ultimate tensile strength.

When substituting P/M steels for conventional steels, physical properties and hardenability requirements must be met. Design engineers and metallurgists are also concerned with consistent response to heat treatment in day to day operations. Heat treatment response in conventional steels is achieved by controlling hardenability. Control of hardenability in powder metallurgy steels can be much easier than in conventional steels if the chemical composition of the powder is predetermined. Thus additions of graphite and copper can be conveniently made to achieve the required hardenability and compensate for the deficiency of certain alloying elements in the base ferrous powder. This is not possible in conventional steels; once a heat is melted and poured and chemistry and the hardenability are fixed. Powder metallurgy steels, such as those in accordance with powders D or E (Table I), when admixed with copper can be substituted for many SAE alloy steels by using the hardenability factors disclosed in this invention. A method of substituting using powders D or E with copper is illustrated in the following two examples:

1. Substitution of powder metallurgy steels for the SAE 5100 series of steels.

Figure 8:
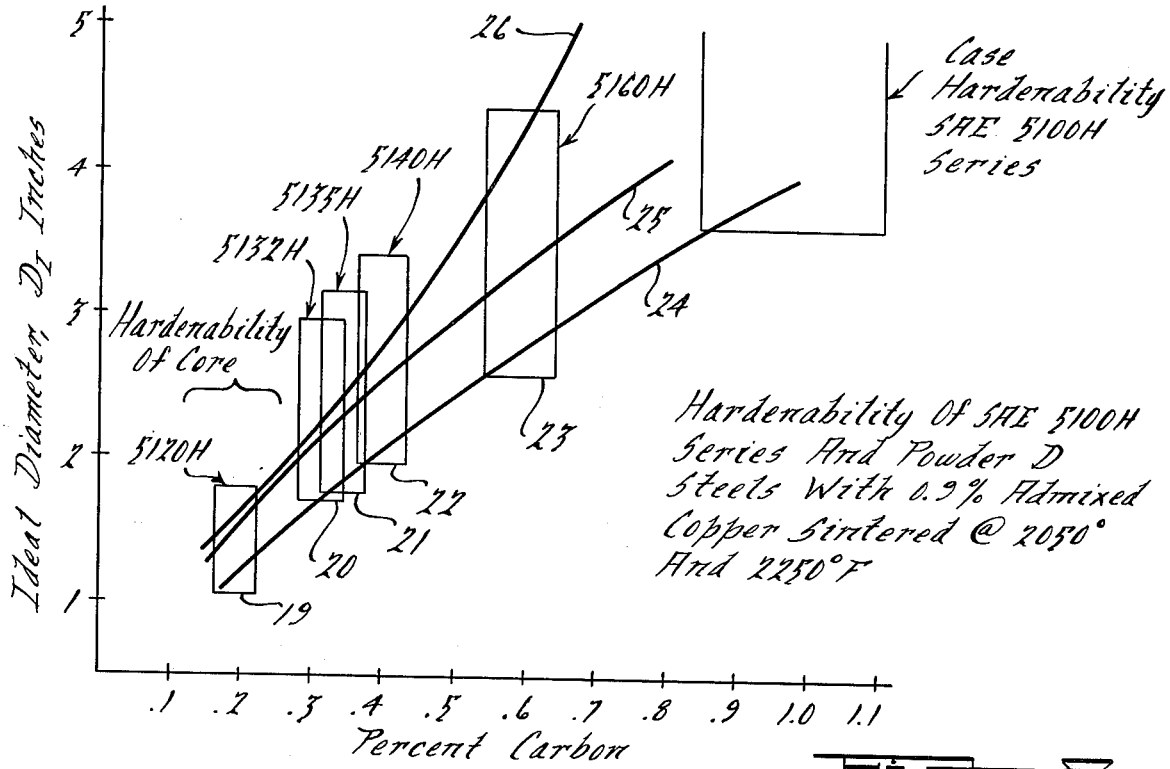
FIG. 8 is a graphical illustration similar to FIG. 1, but comparing the hardenability zones for equivalent alloy steel of the 5000 series with the hardenability of sintered compacts according to this invention.

As shown in FIG. 8, the hardenability of various steels of the SAE 5100H series is represented by a number of rectangles 19 through 23. The SAE 5100 series typically contains 0.7–1.05% chromium, 0.035% phosphorous, 0.04% sulfur, 0.2–.35% silicon, 0.6–1.0% manganese, and carbon varying between 0.17–0.64%.

The vertical sides of each rectangle define the limits of the carbon content from the SAE specification, while the horizontal lines of the rectangle define the limit of the minimum and maximum hardenability of the steel. The hardenability of a powder metallurgy steel at different carbon levels is usually represented by the $D_I$ scatter band determined from Jominy tests for different carbon contents. It can be said that the powder metallurgy steel is equivalent to the conventional steel if the scatter band of the hardenability is contained within the two vertical sides of the rectangle. Usually the scatter band is quite narrow in relation to the height of the rectangle. For simplicity, only the average line of the scatter band is plotted. Thus, in FIG. 8, a modified 4600 powder metallurgy steel, represented by plot 24, is only a marginal substitute for 5120H and 5160H steels and cannot be substituted for the other steels of the series if equivalent hardenability is desired. As shown by plot 25, powder D when admixed with 0.9% copper and sintered under a low oxygen potential atmosphere at 2050° F, is (from an hardenability point of view) an equivalent to the whole 5100 H series of steels. As shown by plot 26, the same powder admixture when sintered at 2250° F is equivalent to 5132H, 5135H and 5140H steels and has an even higher hardenability than the 5160H steel; compared to the carburizing grade 5120H the plot 26 powder metallurgy steel is a good substitute with respect to core properties, and the hardenability of the case is much higher than that of the conventional steel.

2. Substitution of powder metallurgy steels for the SAE 8600H series of steels.

Figure 9:
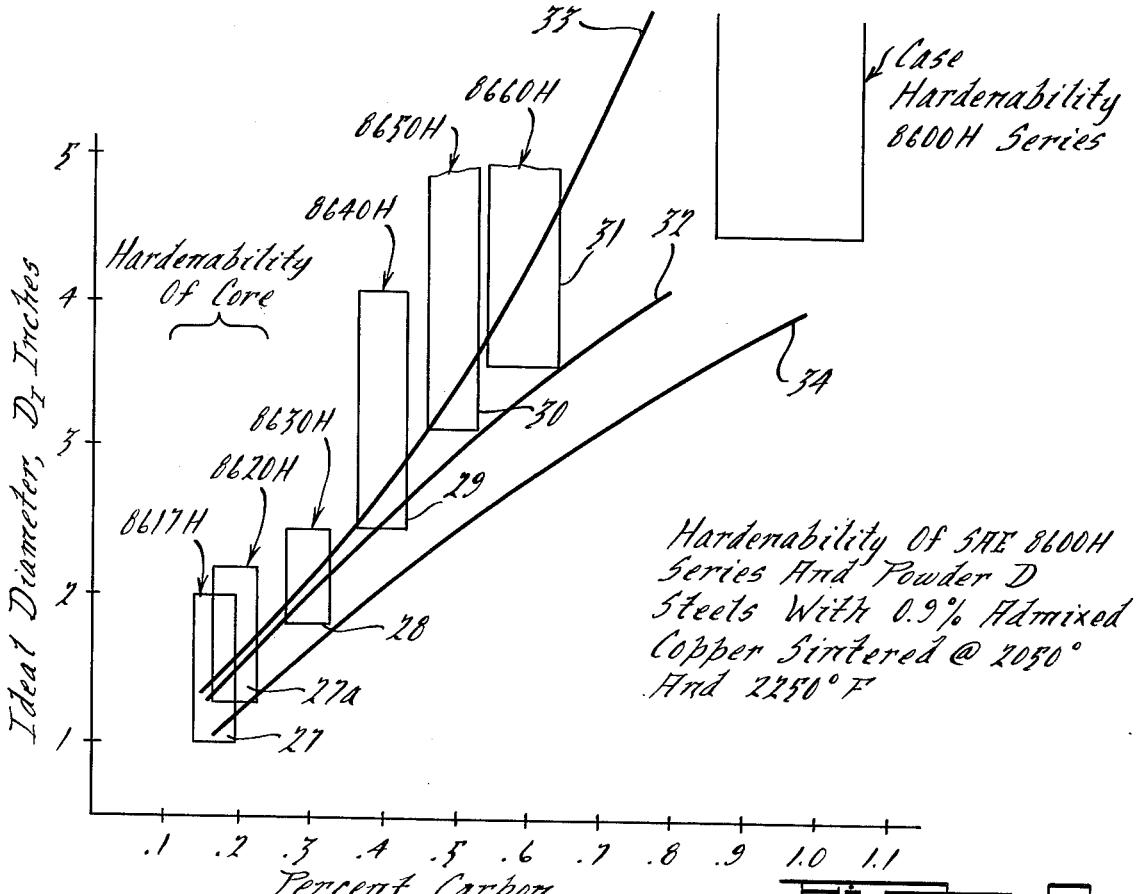
FIG. 9 is a graphical illustration similar to FIG. 6 comparing alloy steels of the 8600 series with the hardenability of sintered compact shapes prepared according to the present invention.

FIG. 9 illustrates the hardenability of the SAE 8600H series of steels and powder metallurgy steels. The 8600 steels typically contain a chemistry of 0.7–1.0% manganese, 0.035% phosphorous, 0.04% sulfur, 0.2–0.35% silicon, 0.4–0.7% nickel, 0.4–0.6% chromium, 0.15–0.25% molybdenum and 0.15–0.64% carbon. The modified 4600 powder metallurgy steel (shown by plot 34) is not a substitute for any of the conventional steels in this series represented by rectangles 27 through 31.

As shown by plot 32, powder D when admixed with 0.9% copper and sintered at 2050° F is a reasonably good substitute for the carburizing grades SAE 8617 and 8620 steels, the case hardenability being only slightly inferior to the conventional steel; it can also be substituted for 8630H steel, but not for the SAE 8640, 8650 and 8660H grades unless the copper addition or the carbon content is increased. If however, the sintering temperature is increased to 2250° F, powder D plus 0.9% copper premix has a higher hardenability of the case than the SAE 8617 and 8620H steels, but equivalent core hardenability (see plot 33). Its hardenability is equivalent to the 8630 and 8660 steels, and marginally equivalent to the steels 8640H and 8650H. To offer an equivalent substitution with respect to hardenability for the latter two steels, copper would have to be increased to 1.1% or carbon range increased by about 0.03%.

Metallographic Examination

Figure 10:
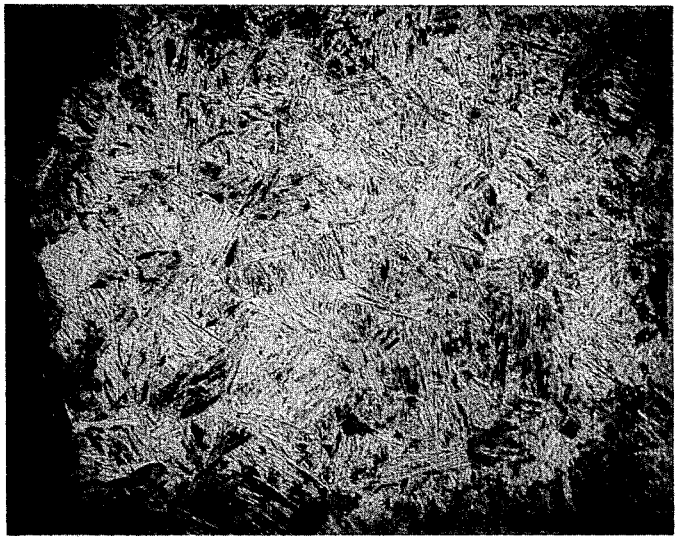
FIGS. 10 and 11 are photomicrographs illustrating respectively the microstructure of sintered hot compacted shapes prepared with a copper admixture according to the invention and without the use of the copper admixture.
Figure 11:
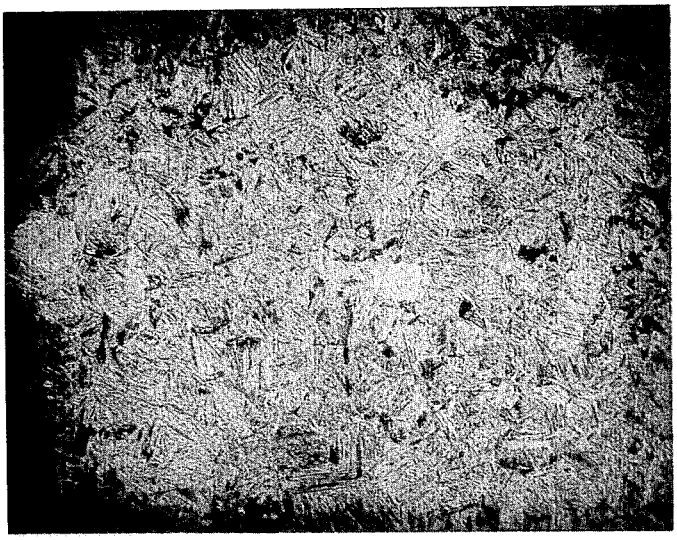

Turning now to FIG. 10, there is illustrated a typical microstructure of a cross-section of a powder metallurgy steel impact bar corresponding to powder D when admixed with 0.9% copper. The sample was austenitized at 1700° F, oil quenched and tempered at 400° F. Hardness is 45 $R_c$. Note the uniformly dispersed tempered martensite structure. The absence of other transformation products is indicative of adequate hardenability and the complete volume diffusion of copper into the interior of the grains. In contrast, FIG. 9 shows the microstructure of a similar bar of powder metallurgy steel with no copper added. It received the same heat treatment to render a hardness of 44 $R_c$. Note that while the structure consists predominantly of tempered martensite, some lower bainite and fine bands of ferrite are also present. The hardenability and the tensile properties of this powder metallurgy steel are about 10% lower than those of the powder metallurgy steel with admixed copper.

Table I

| | CHEMICAL COMPOSITION OF POWDERS Weight Percent | | | | | | | | | ppm $O_2$ | |
|---|---|---|---|---|---|---|---|---|---|---|---|
| Powder | C | Mn | Ni | Cu | Mo | Si | S | P | Cr | Powder | Forging |
| A | 0.01 | 0.09 | 0.60 | 0.04 | 0.62 | .015 | .013 | .013 | ND | 970 | 230 |
| B | 0.01 | 0.12 | 0.01 | 0.03 | 0.65 | .010 | ND | .008 | ND | 760 | 280 |
| C | 0.07 | 0.04 | 0.04 | 0.39 | 0.62 | .016 | ND | .011 | ND | 940 | ND |
| D | 0.01 | 0.34 | 0.43 | 0.06 | 0.65 | ND | .023 | ND | 0.07 | 2400 | 395*, 130+ |
| E | 0.05 | 0.31 | 0.42 | 0.08 | 0.56 | .010 | .017 | .017 | 0.09 | 1700 | 280*, 100+ |
| F | 0.32–.43 | 0.79 | — | — | — | .28 | .023 | .020 | 1.07 | — | — |

*Sintered at 2050° F
+Sintered at 2250° F

Table II

| SUMMARY OF ELECTRON MICROPROBE QUANTITATIVE CHEMICAL ANALYSIS (EVERY 6μ) | | | | | | | | |
|---|---|---|---|---|---|---|---|---|
| | | | | | Manganese | | Copper | |
| Sintered Sample No. | Sintering Temp. | Wet Analysis Weight % % Cu | % Mn | Traverse Length | Avg. Wt. % | Range± Two Sigma | Avg. Wt. % | Range ± Two Sigma |
| D-9 | 1121° C | NIL | .34 | 120μ | .33 | ±0.03 | NIL | NIL |
| | | | | " | .34 | ±0.03 | | |
| | | | | " | .36 | ±0.04 | | |
| D-11 | 1121° C | .92% | .34 | 120μ | .30 | ±0.01 | 0.86 | ±0.12 |
| | | | | " | .33 | ±0.01 | 1.03 | ±0.13 |
| | | | | " | .29 | ±0.02 | 0.79 | ±0.20 |
| | | | | Σ=736μ | .28 | ±0.02 | 0.98 | ±0.20 |
| D-3 | 1232° C | NIL | .34 | 120μ | .35 | ±0.03 | NIL | NIL |
| | | | | " | .32 | ±0.01 | | |
| | | | | " | .32 | ±0.03 | | |
| D-4 | 1232° C | .92% | .34 | 120μ | .35 | ±0.01 | 0.84 | ±0.04 |
| | | | | " | .33 | ±0.01 | 0.99 | ±0.07 |
| | | | | " | .33 | ±0.01 | 1.02 | ±0.05 |

Table II-continued

SUMMARY OF ELECTRON MICROPROBE QUANTITATIVE CHEMICAL ANALYSIS (EVERY 6μ)

| Sintered Sample No. | Sintering Temp. | Wet Analysis Weight % % Cu | % Mn | Traverse Length | Manganese Avg. Wt. % | Range± Two Sigma | Copper Avg. Wt. % | Range ± Two Sigma |
|---|---|---|---|---|---|---|---|---|
| | | | | Σ=374μ | .33 | ±0.01 | 0.84 | ±0.03 |

Table III

MECHANICAL PROPERTIES OF POWDER D STEELS SINTERED AT 2050° F (1121° C), OIL QUENCHED FROM 1700° F (927° C) AND STRESS RELIEVED AT 400° F (204° C) WITHOUT COPPER AND WITH ADMIXED COPPER. NOTE DATA FOR 5135H WROUGHT STEEL, SAMPLE F.

| Sintered Sample No. | % Cu | % C | Tensile Test UTS KSI (MPa) | V.P. KSI MPa) | El. % | R.A. % | V-Notch Charpy Impact −60° F −51° C ft. lbs. (joules) | 0° F −18° C ft. lbs. (joules) | +68 °C +20° C ft. lbs. (joules) | Hardness $R_c$ |
|---|---|---|---|---|---|---|---|---|---|---|
| D-7 | NIL | .25 | 121.2 (836) | 101.4 (698) | 18 | 49 | 12 (16.3) | 12 (16.3) | 13 (17.6) | 26 |
| D-8 | .9 | .25 | 178.5 (1230) | 128.4 (885) | 12 | 31 | 11 (14.9) | 10 (13.6) | 14 (19.0) | |
| D-9 | NIL | .31 | 201.1 (1386) | — | 10 | 20 | 11 (14.9) | 11 (14.9) | 10 (13.6) | 39 |
| D-10 | .9 | .31 | 237.5 (1637) | 181.2 (1249) | 8 | 15 | 8 (10.8) | 8 (10.8) | 9 (12.2) | 46 |
| D-11 | .9 | .36 | 259.7 (1792) | 203.2 (1402) | 10 | 48 | 12 (16.3) | 12 (16.3) | — | 48 |
| F | Longitudinal | | 285.7 (1970) | 261.7 (1804) | 13 | 29 | 5 (6.8) | 7 (9.5) | 9 (12.2) | 54 |
| | Transverse | | 234.2 (1614) | 212.5 (1465) | NIL | 1 | 3 (4.1) | 4 (5.6) | 4 (5.6) | 54 |

Table IV

MECHANICAL PROPERTIES OF POWDER D AND E STEELS SINTERED AT 2250° F (1232° C), OIL QUENCHED FROM 1700° F (927° C) AND STRESS RELIEVED AT 400° F (204° C) WITHOUT COPPER AND WITH ADMIXED COPPER.

| | | | | | | | | | | |
|---|---|---|---|---|---|---|---|---|---|---|
| D-1 | NIL | .25 | 145.1 (1000) | 118.3 (816) | 19 | 46 | 14 (19) | 12 (16.3) | 14 (19) | 38–15 |
| D-2 | .9 | .25 | 191.6 (1320) | 147.8 (1020) | 12 | 30 | 11 (14.9) | 12 (16.3) | 13 (17.6) | 37–42 |
| D-3 | NIL | .30 | 211.5 (1458) | 175.2 (1208) | 13 | 26 | 10 (13.6) | 10 (13.6) | 10 (13.6) | 47 |
| D-4 | .9 | .31 | 243.0 (1675) | 204.6 (1410) | 12.5 | 31 | 11 (14.9) | 11 (14.9) | 10 (13.6) | 49 |
| D-5 | NIL | .35 | 244.5 (1685) | 193.1 (1331) | 11 | 24 | 9 (12.2) | 9 (12.2) | 10 (13.6) | 41–49 |
| D-6 | .9 | .34 | 252.3 (1739) | 199.7 (1378) | 13 | 27 | 9 (12.2) | 10 (13.6) | 11 (14.9) | 43–47 |
| E-1 | NIL | .33 | 199.0 (1372) | 157.1 (1083) | 10.5 | 25 | 9 (12.2) | 9 (12.2) | 9 (12.2) | 47 |
| E-2 | .9 | .31 | 258.3 (1685) | 209.4 (1443) | 9 | 18 | 9 (12.2) | 9 (12.2) | 11 (14.9) | 50 |
| E-3 | NIL | .39 | 256.0 (1765) | 205.2 (1414) | 8.5 | 18 | 7 (9.5) | 8 (10.8) | 8 (10.8) | 51 |
| E-4 | .9 | .39 | 272.5 (1878) | 224.8 (1549) | 12.5 | 24 | 8 (10.8) | 8 (10.8) | 8 (10.8) | 52 |

MECHANICAL PROPERTIES OF POWDER D STEELS WITH ADMIXED COPPER, SINTERED AT 2050° F (1121° C)

| Sintered Sample No. | % Cu | % C | Tensile Properties UTS KSI (MPa) | KSI (MPa) | El. % | Y.P. R.A. % | Impact Properties V-Notch Charpy Ft. −60° F (−51° C) | lbs. 0° F (−18° C) | (Joules) 70° F (21° C) | Hardness $R_c$ |
|---|---|---|---|---|---|---|---|---|---|---|
| D-12 | 0 | .21 | 114.0 (786) | 86.1 (593) | 21 | 50 | 16 (22) | 18 (24) | 22 (30) | 31 |
| D-13 | 0.3 | .23 | 124.2 (857) | 87.1 (601) | 20 | 41 | 13 (18) | 15 (20) | 19 (26) | 36 |
| D-14 | 0.6 | .22 | 134.8 (929) | 87.5 (603) | 18 | 44 | 13 (18) | 13 (18) | 17 (23) | 38 |
| D-15 | 0.9 | .22 | 143.7 (1017) | 93.6 (646) | 19 | 38 | 13 (18) | 13 (18) | 15 (20) | 38 |
| D-16 | 1.2 | .23 | 161.3 (1112) | 106.1 (731) | 10 | 19 | 11 (15) | 12 (16) | 13 (18) | 39 |
| D-17 | 1.5 | .23 | 170.5 (1175) | 114.5 (789) | 10 | 23 | — | 12 (16) | 13 (18) | 40 |
| D-18 | 1.8 | .23 | 190.6 (1314) | 134.4 (927) | 15 | 26 | 11 (15) | 12 (16) | 11 (15) | 41 |
| D-19 | 2.1 | .22 | 183.0 | 122.9 | 10 | 20 | 10 | 10 | 11 | 41 |

-continued

MECHANICAL PROPERTIES OF POWDER D STEELS WITH ADMIXED COPPER, SINTERED AT 2050° F (1121° C)

| Sintered Sample No. | % Cu | % C | Tensile Properties UTS KSI (MPa) | KSI (MPa) | El. % | Y.P. R.A. % | Impact Properties V-Notch Charpy Ft. −60° F (−51° C) | lbs. 0° F (−18° C) | (Joules) 70° F (21° C) | Hardness $R_c$ |
|---|---|---|---|---|---|---|---|---|---|---|
| | | | (1262) | (848) | | | (14) | (14) | (15) | |

Table VI

MECHANICAL PROPERTIES OF POWDER D STEELS WITH COPPER, SINTERED AT 2250° F (1232° C)

| | | | | | | | | | | |
|---|---|---|---|---|---|---|---|---|---|---|
| D-20 | 0 | .19 | 119.9 (826) | 88.6 (610) | 27 | 59 | 16 (22) | 16 (22) | 31 (42) | 33 |
| D-21 | 0.3 | .21 | 128.5 (885) | 86.8 (598) | 23 | 54 | 15 (20) | 18 (24) | 27 (37) | 31 |
| D-22 | 0.6 | .21 | 151.0 (1041) | 99.3 (685) | 18 | 44 | 15 (20) | 15 (20) | 17 (23) | 37 |
| D-23 | 0.9 | .22 | 147.6 (1014) | 99.3 (685) | 18 | 39 | 16 (22) | 16 (22) | 17 (23) | 38 |
| D-24 | 1.2 | .22 | 187.0 (1289) | 126.9 (876) | 15 | 38 | 13 (18) | 13 (18) | 15 (20) | 40 |
| D-25 | 1.5 | .22 | 191.1 (1317) | 140.5 (968) | 12 | 29 | 15 (20) | 15 (20) | 14 (19) | 40 |
| D-26 | 1.8 | .21 | 203.1 (1400) | 137.1 (946) | 13 | 39 | 14 (19) | 15 (20) | 16 (22) | 41 |
| D-27 | 2.1 | .22 | 193.9 (1338) | 142.9 (985) | 15 | 35 | 13 (18) | 14 (19) | 13 (18) | 42 |

We claim:

1. A prealloyed ferrous-based powder useful for promoting optimum hardenability when exposed to copper and carbon during sintering, said powder having a mesh size of −80, each particle of said powder being characterized by a substantially irregular spherical configuration consisting of a steel alloy having 0.4–0.65% by weight of molybdenum with or without nickel addition, the remainder being substantially iron, said molybdenum and/or nickel being distributed throughout each of said particles to form an alloy phase at the outer region of each particle which is richer in molybdenum and/or nickel, said powder having an oxygen content no greater than 0.25%, and a carbon content less than 0.04%.

2. A prealloyed ferrous-based powder as in claim 1, in which said steel alloy consists additionally of manganese in the range of 0.4–0.65% by weight.

3. A powder metal preform of the same weight as the intended final part to be fabricated, comprising: a shape sized greater in length and smaller in width than the final configuration of the product to be formed from said preform allowing for lesser density, said shape consisting of an admixture of three distinct powders, a first powder comprising a ferrous-based material having molybdenum with or without nickel, each in a range of 0.4–0.65% by weight of the powder mass, a second powder consisting essentially of copper and/or manganese, and a third powder consisting of graphite, said first powder being particularly characterized by carbon content less than 0.04% by weight and oxygen content of no greater than 0.25%, the mesh size of said first and second powders being regulated to −80 and −320 mesh respectively.

4. The powder metal preform as in claim 3 in which said second powder has said copper and manganese in predetermined proportions varying between 1:4 to 10:1.

* * * * *